United States Patent [19]

White

[11] 3,973,798

[45] Aug. 10, 1976

[54] DEFLECTABLE CHAIR BACK

[75] Inventor: David B. White, Monroe, Mich.

[73] Assignee: La-Z-Boy Chair Company, Monroe, Mich.

[22] Filed: Mar. 5, 1975

[21] Appl. No.: 555,607

Related U.S. Application Data

[63] Continuation-in-part of Ser. No. 458,234, April 5, 1975, abandoned.

[52] U.S. Cl. ..... 297/296; 297/440

[51] Int. Cl.[2] ..... A47C 3/00; A47C 7/00

[58] Field of Search ..... 297/285, 298, 300, 306, 297/316, 452, 450, 440, 443, 296, 301, 302, 304, 303

[56] References Cited

UNITED STATES PATENTS

| | | | |
|---|---|---|---|
| 518,097 | 4/1894 | Derby | 297/293 X |
| 606,992 | 7/1898 | Hofstatter | 297/286 |
| 1,150,189 | 8/1915 | Heater | 297/293 |
| 1,998,090 | 4/1935 | Larsen | 297/300 |
| 2,032,288 | 2/1936 | Kuss | 297/286 |
| 2,109,697 | 3/1938 | Hanauer | 297/296 |
| 2,570,177 | 10/1951 | Wood | 297/306 |
| 2,764,224 | 9/1956 | Maurer | 297/316 X |
| 3,036,864 | 5/1962 | Arai | 297/440 |
| 3,525,549 | 8/1970 | Knabusch | 297/440 X |

*Primary Examiner*—James T. McCall

*Attorney, Agent, or Firm*—Harness, Dickey & Pierce

[57] ABSTRACT

The chair is preferably of the overstuffed type having a back which is separate from the seat. Brackets are provided on the sides of the seat and back forming a rod-receiving loop therewith. The loops are interconnected by heavy spring rods which permits the removal of the back for compact shipment and which permits the upholstered back to deflect relative to the upholstered seat frame and arms. The seat frame may be supported on a base by a rocking and swiveling mechanism or it may be fixed directly thereto.

6 Claims, 5 Drawing Figures

DEFLECTABLE CHAIR BACK

This is a continuation in part application of application Ser. No. 458,234, filed Apr. 5, 1974, now abandoned and assigned to the assignee of the present invention.

BACKGROUND OF THE INVENTION

Reference may be had to patents Re. 1,986; 35,761 and 1,946,113 to show the state of the art of chair backs which pivot relative to the seat frame. Such structures however do not employ the spring rods for removably supporting the back and permitting the back to deflect relative to the base.

SUMMARY OF THE INVENTION

The invention pertains to the use of a pair of spaced spring rods attached at the lower ends to the seat for releasably supporting a back on the upper ends thereof. Brackets are attached to the sides of the seat and back in which the ends of the rods are supported. The seat brackets have a lanced out finger at the bottom which prevents the rods from moving therebelow while the brackets on the back have a lanced out finger at the top which limits the downward movement of the back on the top ends of the rods. This arrangement permits the upholstered back to be lifted from the top ends of the rods so that it can be placed upon the upholstered seat and thereby substantially reduce the shipping volume of the chair. The deflection of the back with the two rods permits the back and a cushion thereon to be extremely thin so as to encompass the occupant's back when applying pressure to the back even though the set of springs usually employed in chair backs is eliminated. When the chair is mounted on a base with a rocking mechanism, the application of pressure to the back extends the rocking distance and cushions the effort of rocking the chair.

DESCRIPTION OF THE PREFERRED EMBODIMENT

Figure 1:
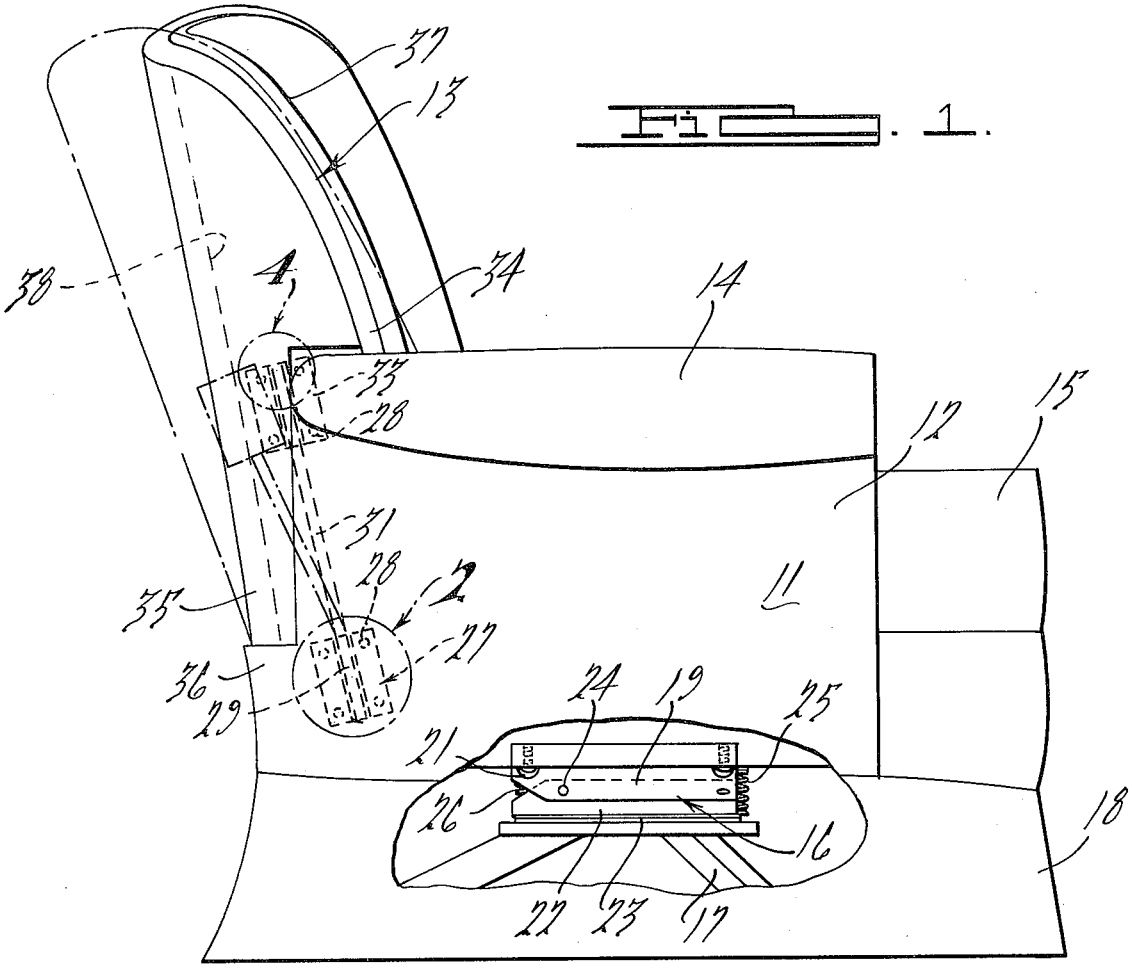
FIG. 1 is a broken view in side elevation of a swivel rocking chair embodying features of the present invention.
Figure 2:
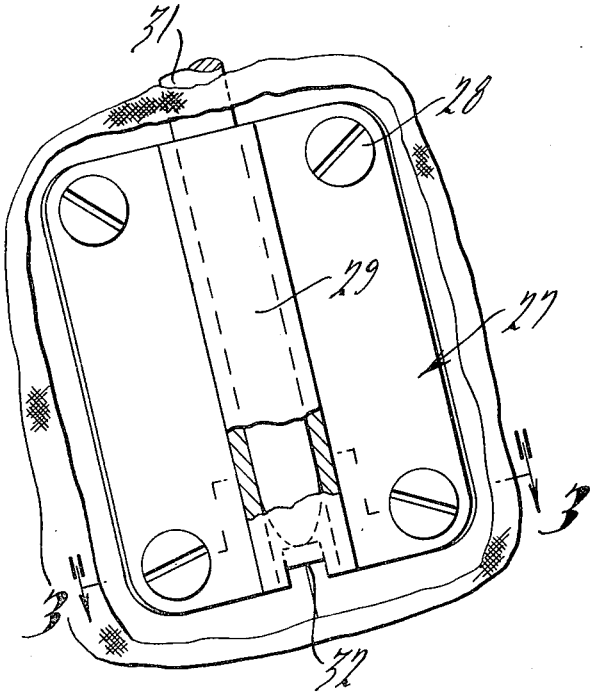
FIG. 2 is an enlarged view of a supporting bracket on the chair frame, as viewed in the circle 2 of FIG. 1.
Figure 3:
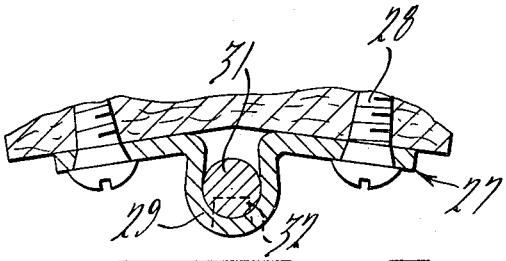
FIG. 3 is a sectional view of the structure illustrated in FIG. 2, taken on the line 3—3 thereof.
Figure 4:
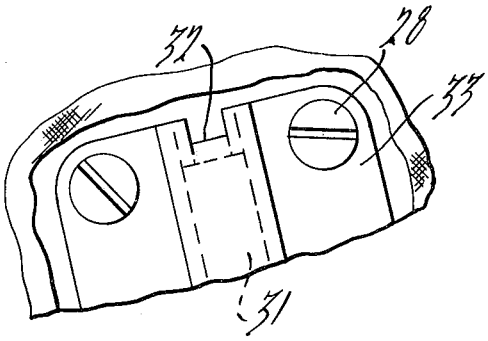
FIG. 4 is an enlarged broken view of the structure illustrated in FIG. 1, as viewed within the circle 4 thereof.
Figure 5:
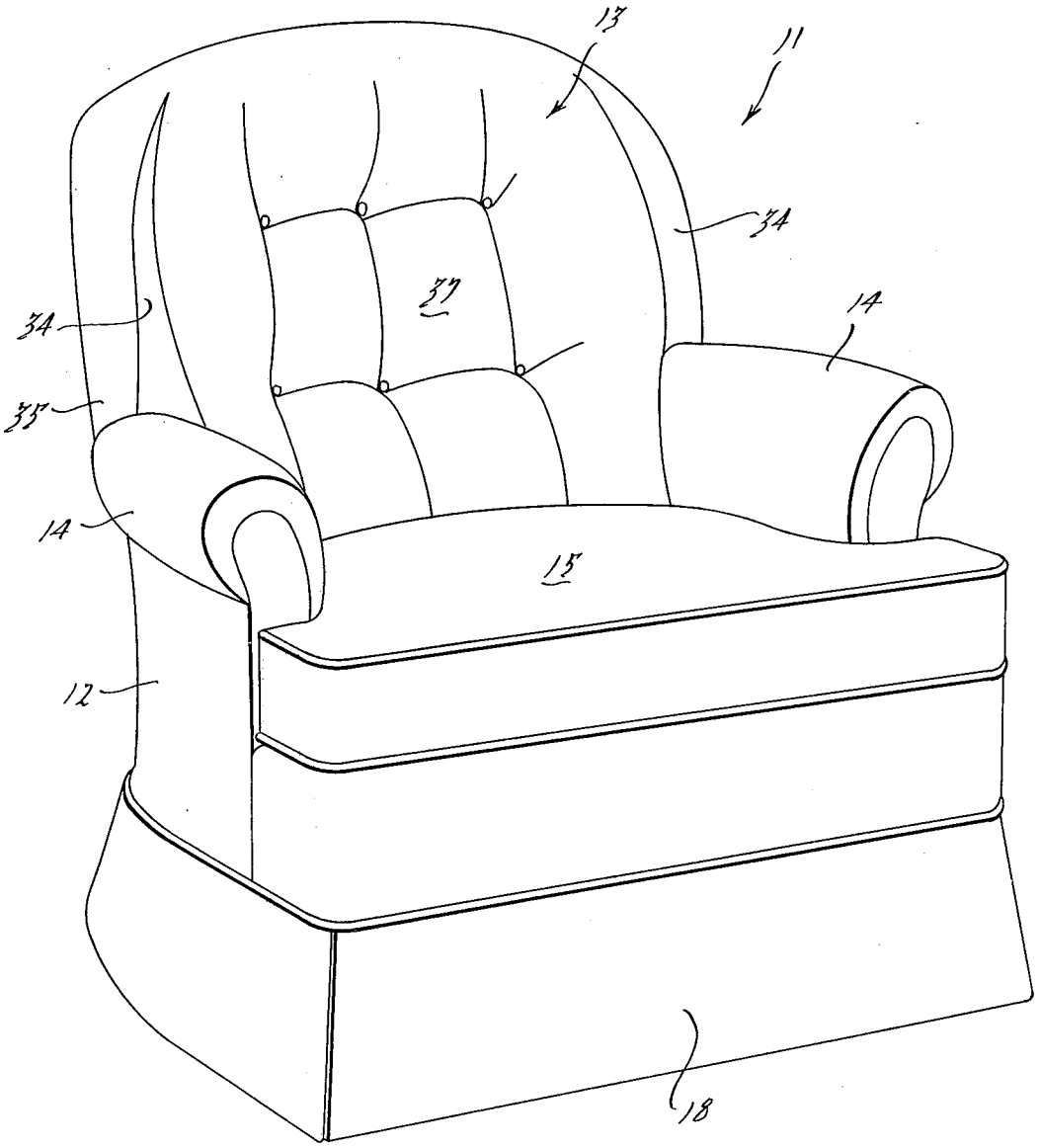
FIG. 5 is a front view of the upholstered chair illustrated in FIG. 1.

A chair 11 has an upholstered seat frame 12, an upholstered back 13, upholstered arm rests 14 and an upholstered seat cushion 15 secured by a swivel rocking device 16 on a supporting base 17. A skirt 18 hides the device 16 and base 17 from view. The device 16 comprises a downwardly presenting channel element 19 secured by screws 21 to the underside of the seat frame 12. An upwardly presenting channel element 22 is secured to a swivel mechanism 23 which is secured to the base 17. The channel elements 19 and 22 are secured together by pivots 24 disposed transversely of the seat frame 12 to permit the chair to rock forwardly and rearwardly against the pressure of the sets of springs 25 and 26. The swivel mechanism 23 comprises a pair of circular plates pivoted together at the center with a set of ball bearings in facing annular grooves about the pivot which is conventional construction.

Each side support of the upholstered chair frame 12 at the rear thereof has a bracket 27 secured thereto by screws 28. The bracket 27 has a central loop 29 therein in which a spring rod 31 is supported. A lanced out tongue 32 positions the rods within the brackets. Similar brackets 33 are secured to the side elements of the upholstered back above the brackets 27 by the screws 28. The central loop 29 of the brackets 33 have a struck out tongue 32 at the top which limits the downward movement of the brackets and back relative to the top ends of the rods 31. This arrangement permits the upholstered back to be lifted off of the rods for compact shipment by placing it on the upholstered cushion 15 between the arms 14.

The back has upholstered wings 34 at each side which extend over the upholster material at the rear ends of the arms 14 in position to have the upholstered wings move rearwardly and forwardly relatively thereto. The downwardly extending upholstered portion 35 of the back is disposed within an area defined by the upholstered rear wall 36 of the chair frame in which it is freely movable. The back has a cushion 37 secured forwardly of the upholstered back frame section 38 providing an enveloping back rest, with the occupant's back deeply embedded therein permitting the heavy spring assembly normally used in the back to be eliminated as the spring comfort is obtained from the movement of the back on the rods 31.

In the chair illustrated, the occupant may swivel in either direction and rock backwardly and forwardly. When applying rocking pressure, the seat back moves rearwardly an amount conforming to the applied pressure while maintaining the upholstering material between the back, arms and seat cushion in engagement with each other. A certain percentage of the applied pressure will tilt the seat frame 12 backwardly on the base 17 while the remainder will tilt the upholstered back 13 relative to the upholstered seat frame 14. This will extend the rocking distance and cushion the pressure as it is applied due to the deflection of the seat frame 12 on the base 17 while the back 13 is deflecting relative to the seat frame. As the pressure is applied by the occupant's back, the thin chair back and cushion will permit the back of the occupant to be encompassed by the cushion and provide extra comfort therefor. In this manner, the back will flex and adjust to the applied pressure by the occupant while maintaining the upholstery material of the back, arms and seat in engagement. The heavy spring tempered rods control the deflection of the back and permits the back' s removal so that it can be compactly stored for shipment. The thin back with the cushion on the front face provides the same or greater comfort to the occupant as that employing the spring unit due to the depth of the back and the encompassing effect of the cushion. This comfort is provided when the seat frame 12 is fixed to the base eliminating the swiveling and rocking features while retaining the deflecting feature to the back.

I claim:

1. In a chair, a chair frame having a central seating area and an arm at each side, a supporting base, a back frame separate from said chair frame, upholstering material on said chair and back frames, a pair of unstressed spring rods for supporting said upholstered back frame at the rear of said chair frame to extend upwardly thereon so that the upholstering material at the sides of the back frame is in engagement with the upholstered material at the rear of the arms of said seat frame to provide the appearance of a continuous back frame on the chair frame, said back frame being deflectable rearwardly on said spring rods which are hidden beneath the upholstering material on said back frame which is in engagement with that on said arms.

2. In a chair as recited in claim 1, wherein said spring rods are straight with the upper ends supporting said back frame in a manner to conceal said rods.

3. In a chair as recited in claim 2, wherein said back frame is movable upwardly from the upper end of said spring rods and disposable on the seat frame between said arms for compact shipment.

4. In a chair as recited in claim 3, wherein a pair of brackets are mounted on the upholstered seat frame adjacent to the rear end of said arms, and wherein a pair of brackets is mounted at the sides of said upholstered back frame, the ends of said rods extending into said brackets for supporting said back unit on the frame unit in a manner to hide the brackets and rods between the upholstery material on said back frame and arms.

5. In a chair as recited in claim 4, wherein said brackets on the chair frame have an aperture forming socket which presents upwardly and said brackets on the back frame have aperture forming sockets which present downwardly.

6. In a chair as recited in claim 4, wherein said back frame is slid downwardly at the rear end of the arms into supporting engagement with the upper ends of the rods and with the upholstering material at the rear of the seat frame and arms and that at the sides of the back frame in engagement with each other.

* * * * *